US011371709B2

(12) United States Patent
Bhagat

(10) Patent No.: US 11,371,709 B2
(45) Date of Patent: Jun. 28, 2022

(54) COMBUSTOR AIR FLOW PATH

(71) Applicant: General Electric Company, Schenectady, NY (US)

(72) Inventor: Reena Bhagat, Bangalore (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 16/916,483

(22) Filed: Jun. 30, 2020

(65) Prior Publication Data

US 2021/0404662 A1 Dec. 30, 2021

(51) Int. Cl.

| | |
|---|---|
| ***F23R 3/00*** | (2006.01) |
| ***F23R 3/34*** | (2006.01) |
| ***F23R 3/28*** | (2006.01) |

(52) U.S. Cl.

CPC ..... *F23R 3/346* (2013.01); *F23R 3/002* (2013.01); *F23R 3/283* (2013.01); *F05D 2220/323* (2013.01); *F05D 2260/20* (2013.01)

(58) Field of Classification Search

CPC ..... F23R 3/346; F23R 3/002; F23R 3/283
See application file for complete search history.

(56) References Cited

U.S. PATENT DOCUMENTS

| | | | |
|---|---|---|---|
| 2,922,279 | A | 1/1960 | Roberson et al. |
| 3,872,664 | A | 3/1975 | Lohmann et al. |
| 3,934,409 | A | 1/1976 | Quillevere et al. |
| 4,040,252 | A | 8/1977 | Mosier et al. |
| 4,045,956 | A | 9/1977 | Markowski et al. |
| 4,112,676 | A | 9/1978 | DeCorso |
| 4,253,301 | A | 3/1981 | Vogt |
| 4,265,615 | A | 5/1981 | Lohmann et al. |
| 4,288,980 | A | 9/1981 | Ernst |
| 4,420,929 | A | 12/1983 | Jorgensen et al. |
| 4,928,481 | A | 5/1990 | Joshi et al. |
| 5,054,280 | A | 10/1991 | Ishibashi et al. |

(Continued)

FOREIGN PATENT DOCUMENTS

| | | | |
|---|---|---|---|
| CA | 3014977 | A1 | 2/2019 |
| CN | 108457752 | A | 8/2018 |

(Continued)

OTHER PUBLICATIONS

European Patent Office, Extended EP Search Report for corresponding EP Application No. 21179247.8, dated Nov. 8, 2021, 8 pages.

*Primary Examiner* — Katheryn A Malatek
(74) *Attorney, Agent, or Firm* — Dority & Manning, P.A.

(57) ABSTRACT

A combustor for a turbomachine includes a head end, a liner at least partially defining a hot gas path, and a flow sleeve circumferentially surrounding at least a portion of the liner. The flow sleeve is spaced from the liner to form a cooling flow annulus therebetween. The cooling flow annulus is in direct fluid communication with a high pressure plenum, whereby air from the high pressure plenum flows into the cooling flow annulus and from the cooling flow annulus to the head end. The combustor further includes a first combustion zone and a second combustion zone downstream of the first combustion zone along the hot gas path. A plurality of fuel injectors are in fluid communication with the second combustion zone and are not in direct fluid communication with the high pressure plenum.

12 Claims, 6 Drawing Sheets

(56) References Cited

U.S. PATENT DOCUMENTS

| | | | |
|---|---|---|---|
| 5,069,029 | A | 12/1991 | Kuroda et al. |
| 5,099,644 | A | 3/1992 | Sabla et al. |
| 5,127,229 | A | 7/1992 | Ishibashi et al. |
| 5,297,391 | A | 3/1994 | Roche |
| 5,321,948 | A | 6/1994 | Leonard |
| 5,380,154 | A | 1/1995 | Norton et al. |
| 5,450,725 | A | 9/1995 | Takahara et al. |
| 5,475,979 | A | 12/1995 | Oag et al. |
| 5,623,819 | A | 4/1997 | Bowker et al. |
| 5,749,219 | A | 5/1998 | DuBell |
| 5,974,781 | A | 11/1999 | Correa et al. |
| 6,047,550 | A | 4/2000 | Beebe |
| 6,148,604 | A | 11/2000 | Salt et al. |
| 6,178,737 | B1 | 1/2001 | Lenertz et al. |
| 6,192,688 | B1 | 2/2001 | Beebe |
| 6,212,870 | B1 | 4/2001 | Thompson et al. |
| 6,253,538 | B1 | 7/2001 | Sampath et al. |
| 6,374,594 | B1 | 4/2002 | Kraft et al. |
| 6,442,946 | B1 | 9/2002 | Kraft et al. |
| 6,450,762 | B1 | 9/2002 | Munshi |
| 6,543,993 | B2 | 4/2003 | Burdgick et al. |
| 6,654,710 | B1 | 11/2003 | Keller |
| 6,868,676 | B1 | 3/2005 | Haynes |
| 6,875,009 | B2 | 4/2005 | Kayahara et al. |
| 6,896,509 | B2 | 5/2005 | Carroni et al. |
| 6,925,809 | B2 | 8/2005 | Mowill |
| 6,935,116 | B2 | 8/2005 | Stuttaford et al. |
| 6,957,949 | B2 | 10/2005 | Hyde et al. |
| 7,082,766 | B1 | 8/2006 | Widener et al. |
| 7,137,256 | B1 | 11/2006 | Stuttaford et al. |
| 7,162,875 | B2 | 1/2007 | Fletcher et al. |
| 7,237,384 | B2 | 7/2007 | Stuttaford et al. |
| 7,425,127 | B2 | 9/2008 | Zinn |
| 7,665,309 | B2 | 2/2010 | Parker et al. |
| 7,743,612 | B2 | 6/2010 | Morenko |
| 8,096,131 | B2 | 1/2012 | Ziaei et al. |
| 8,158,428 | B1 | 4/2012 | Krishna et al. |
| 8,171,738 | B2 | 5/2012 | Fish et al. |
| 8,475,160 | B2 | 7/2013 | Campbell et al. |
| 8,677,753 | B2 | 3/2014 | Melton et al. |
| 9,052,115 | B2 | 6/2015 | Stoia et al. |
| 9,097,424 | B2 | 8/2015 | Chen et al. |
| 9,151,500 | B2 | 10/2015 | Chen et al. |
| 9,170,024 | B2 | 10/2015 | Stoia et al. |
| 9,188,337 | B2 | 11/2015 | Stoia et al. |
| 9,284,888 | B2 | 3/2016 | Romig et al. |
| 9,316,155 | B2 | 4/2016 | DiCintio et al. |
| 9,316,396 | B2 | 4/2016 | DiCintio et al. |
| 9,322,556 | B2 | 4/2016 | Melton et al. |
| 9,360,217 | B2 | 6/2016 | DiCintio et al. |
| 9,383,104 | B2 | 7/2016 | Melton et al. |
| 9,400,114 | B2 | 7/2016 | Melton et al. |
| 9,429,325 | B2 | 8/2016 | Shershnyov et al. |
| 9,593,851 | B2 | 3/2017 | Shershnyov et al. |
| 9,631,812 | B2 | 4/2017 | Stoia et al. |
| 10,436,445 | B2 | 10/2019 | Willis et al. |
| 2002/0184893 | A1 | 12/2002 | Farmer et al. |
| 2003/0039542 | A1 | 2/2003 | Cromer |
| 2005/0044855 | A1 | 3/2005 | Crawley et al. |
| 2005/0095542 | A1 | 5/2005 | Sanders et al. |
| 2005/0097889 | A1 | 5/2005 | Pilatis et al. |
| 2005/0241317 | A1 | 11/2005 | Martling et al. |
| 2005/0268617 | A1 | 12/2005 | Amond, III et al. |
| 2007/0022758 | A1 | 2/2007 | Myers et al. |
| 2007/0137207 | A1 | 6/2007 | Mancini et al. |
| 2008/0282667 | A1 | 11/2008 | Intile et al. |
| 2009/0071157 | A1 | 3/2009 | Cai |
| 2009/0084082 | A1 | 4/2009 | Martin et al. |
| 2009/0199561 | A1 | 8/2009 | Hessler |
| 2010/0018208 | A1 | 1/2010 | Ritland |
| 2010/0018209 | A1 | 1/2010 | Ramier et al. |
| 2010/0054928 | A1 | 3/2010 | Schiavo |
| 2010/0071377 | A1 | 3/2010 | Fox et al. |
| 2010/0139283 | A1 | 6/2010 | Phillips et al. |
| 2010/0170216 | A1 | 7/2010 | Venkataraman et al. |
| 2010/0174466 | A1 | 7/2010 | Davis, Jr. et al. |
| 2010/0263386 | A1 | 10/2010 | Edwards et al. |
| 2011/0056206 | A1 | 3/2011 | Wiebe |
| 2011/0067402 | A1 | 3/2011 | Wiebe et al. |
| 2011/0131998 | A1 | 6/2011 | Nadkami et al. |
| 2011/0146284 | A1 | 6/2011 | Morimoto et al. |
| 2011/0179803 | A1 | 7/2011 | Berry et al. |
| 2011/0247314 | A1 | 10/2011 | Chila et al. |
| 2011/0296839 | A1 | 12/2011 | Van Nieuwenhuizen et al. |
| 2011/0304104 | A1 | 12/2011 | McMahan et al. |
| 2012/0186260 | A1 | 7/2012 | DiCintio et al. |
| 2012/0210729 | A1 | 8/2012 | Cihlar et al. |
| 2012/0304648 | A1 | 12/2012 | Byrne et al. |
| 2013/0008169 | A1 | 1/2013 | Belsom et al. |
| 2013/0167547 | A1 | 7/2013 | Stoia et al. |
| 2013/0180253 | A1 | 7/2013 | Stoia et al. |
| 2013/0283807 | A1 | 10/2013 | Stoia et al. |
| 2013/0285560 | A1 | 10/2013 | Nakajima et al. |
| 2014/0033728 | A1 | 2/2014 | Marmilic et al. |
| 2014/0096530 | A1 | 4/2014 | Chen |
| 2014/0116053 | A1* | 5/2014 | Chen ..... F23R 3/045 60/737 |
| 2014/0260272 | A1* | 9/2014 | DiCintio ..... F01D 9/023 60/739 |
| 2014/0260273 | A1* | 9/2014 | Melton ..... F23R 3/346 60/722 |
| 2014/0260277 | A1 | 9/2014 | DiCintio et al. |
| 2014/0260318 | A1 | 9/2014 | Willis et al. |
| 2014/0360193 | A1* | 12/2014 | Stoia ..... F23R 3/00 60/722 |
| 2017/0175636 | A1 | 6/2017 | Hughes et al. |
| 2017/0176014 | A1* | 6/2017 | Hughes ..... F01D 5/187 |
| 2018/0010798 | A1 | 1/2018 | Pettersson et al. |
| 2018/0112875 | A1* | 4/2018 | Daniel ..... F02C 7/228 |
| 2019/0010869 | A1 | 1/2019 | Kerth |
| 2019/0017705 | A1 | 1/2019 | Liu |
| 2019/0048799 | A1 | 2/2019 | Kishida |
| 2019/0063324 | A1 | 2/2019 | Gould et al. |

FOREIGN PATENT DOCUMENTS

| | | | |
|---|---|---|---|
| EP | 0526058 | A1 | 2/1993 |
| EP | 0578461 | A1 | 1/1994 |
| EP | 1884297 | A1 | 2/2008 |
| EP | 2236935 | A2 | 6/2010 |
| EP | 2206964 | A2 | 7/2012 |
| EP | 2613082 | A1 | 7/2013 |
| JP | 2006/138566 | A | 6/2006 |
| JP | 2018115594 | A | 7/2018 |
| RU | 2677018 | C1 | 1/2019 |
| WO | WO2004/035187 | A2 | 4/2004 |

* cited by examiner

COMBUSTOR AIR FLOW PATH

FIELD

The present disclosure relates generally to combustors for turbomachines. More particularly, the present disclosure relates to combustors having axially staged fuel injectors and features which define an air flow path for such combustors.

BACKGROUND

Turbomachines are utilized in a variety of industries and applications for energy transfer purposes. For example, a gas turbine engine generally includes a compressor section, a combustion section, a turbine section, and an exhaust section. The compressor section progressively increases the pressure of a working fluid entering the gas turbine engine and supplies this compressed working fluid to the combustion section. The compressed working fluid and a fuel (e.g., natural gas) mix within the combustion section and burn in a combustion chamber to generate high pressure and high temperature combustion gases. The combustion gases flow from the combustion section into the turbine section where they expand to produce work. For example, expansion of the combustion gases in the turbine section may rotate a rotor shaft connected, e.g., to a generator to produce electricity. The combustion gases then exit the gas turbine via the exhaust section.

Gas turbines usually burn hydrocarbon fuels and produce emissions such as oxides of nitrogen (NOx) and carbon monoxide (CO). It is generally desired to minimize the production of such emissions. Oxidization of molecular nitrogen in the gas turbine depends upon the temperature of gas located in a combustor, as well as the residence time for reactants located in the highest temperature regions within the combustor. Thus, the amount of NOx produced by the gas turbine may be reduced by either maintaining the combustor temperature below a temperature at which NOx is produced, or by limiting the residence time of the reactant in the combustor.

One approach for controlling the temperature of the combustor involves pre-mixing fuel and air to create a lean fuel-air mixture prior to combustion. This approach may include the axial staging of fuel injection where a first fuel-air mixture is injected and ignited at a first or primary combustion zone of the combustor to produce a main flow of high energy combustion gases, and where a second fuel-air mixture is injected into and mixed with the main flow of high energy combustion gases via a plurality of radially oriented and circumferentially spaced fuel injectors or axially staged fuel injector assemblies (sometimes also referred to as late lean injectors) positioned downstream from the primary combustion zone. Axially staged injection increases the likelihood of complete combustion of available fuel, which in turn reduces the undesired emissions.

During operation of the combustor, it is necessary to cool one or more liners or ducts that form a combustion chamber and/or a hot gas path through the combustor. Liner cooling is typically achieved by routing a cooling medium, such as the compressed working fluid from the compressor, through a cooling flow annulus or flow passage defined between the liner and a flow sleeve and/or an impingement sleeve that surrounds the liner. As a result, the portion of the compressed working fluid diverted through the axially staged injectors may reduce the amount of cooling provided to the outside of the combustion chamber.

Therefore, an improved system and method for supplying the compressed working fluid to the axially staged injectors without reducing the cooling provided to the combustion liner or ducts would be useful.

BRIEF DESCRIPTION

Aspects and advantages of the systems in accordance with the present disclosure will be set forth in part in the following description, or may be obvious from the description, or may be learned through practice of the technology.

In accordance with one embodiment, a combustor for a turbomachine is provided. The combustor is coupled to an outer casing of the turbomachine and in fluid communication with a high pressure plenum within the outer casing. The combustor includes a head end, a liner at least partially defining a hot gas path, and a flow sleeve circumferentially surrounding at least a portion of the liner. The flow sleeve is spaced from the liner to form a cooling flow annulus therebetween. The cooling flow annulus is in direct fluid communication with the high pressure plenum, whereby air from the high pressure plenum flows into the cooling flow annulus and from the cooling flow annulus to the head end. The combustor also includes a first combustion zone defined by the liner and a second combustion zone defined by the liner downstream of the first combustion zone along the hot gas path. A plurality of fuel injectors is in fluid communication with the second combustion zone. The plurality of fuel injectors is configured to inject a mixture of fuel and air directly into the second combustion zone. The plurality of fuel injectors is not in direct fluid communication with the high pressure plenum.

In accordance with another embodiment, a turbomachine is provided. The turbomachine includes a compressor extending from an inlet to a discharge. The discharge of the compressor provides a flow of high pressure air directly into a high pressure plenum defined within an outer casing of the turbomachine. The turbomachine also includes a combustor. The combustor includes a head end, a liner at least partially defining a hot gas path, and a flow sleeve circumferentially surrounding at least a portion of the liner. The flow sleeve is spaced from the liner to form a cooling flow annulus therebetween. The cooling flow annulus is in direct fluid communication with the high pressure plenum, whereby air from the high pressure plenum flows into the cooling flow annulus and from the cooling flow annulus to the head end. The combustor also includes a first combustion zone defined by the liner and a second combustion zone defined by the liner downstream of the first combustion zone along the hot gas path. A plurality of fuel injectors is in fluid communication with the second combustion zone. The plurality of fuel injectors is configured to inject a mixture of fuel and air directly into the second combustion zone. The plurality of fuel injectors is not in direct fluid communication with the high pressure plenum. The turbomachine further includes a turbine downstream of the combustor and an exhaust downstream of the turbine.

These and other features, aspects and advantages of the present assemblies will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present systems, including the best mode of making and using the present assemblies, directed to one of ordinary skill in the art, is set forth in the specification, which makes reference to the appended figures, in which.

DETAILED DESCRIPTION

Figure 1:
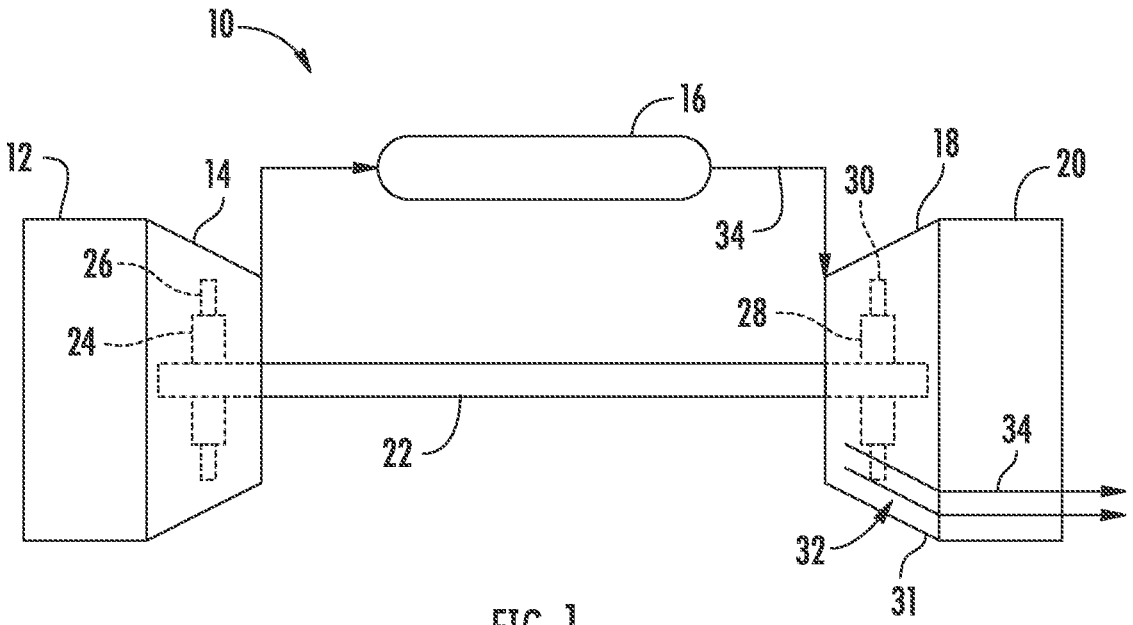
FIG. 1 is a schematic illustration of a turbomachine in accordance with embodiments of the present disclosure.

Reference now will be made in detail to embodiments of the present systems, one or more examples of which are illustrated in the drawings. Each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents.

The detailed description uses numerical and letter designations to refer to features in the drawings. Like or similar designations in the drawings and description have been used to refer to like or similar parts of the invention. As used herein, the terms "first," "second," and "third" may be used interchangeably to distinguish one component from another and are not intended to signify location or importance of the individual components.

As used herein, the terms "upstream" (or "forward") and "downstream" (or "aft") refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, the term "axially" refers to the relative direction that is substantially parallel to and/or coaxially aligned with an axial centerline of a particular component, and the term "circumferentially" refers to the relative direction that extends around the axial centerline of a particular component. Terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Referring now to the drawings, FIG. 1 illustrates a schematic diagram of one embodiment of a turbomachine, which in the illustrated embodiment is a gas turbine 10. Although an industrial or land-based gas turbine is shown and described herein, the present disclosure is not limited to an industrial or land-based gas turbine unless otherwise specified in the claims. For example, the systems as described herein may be used in any type of turbomachine including, but not limited to, a steam turbine, an aircraft gas turbine, or a marine gas turbine.

Figure 2:
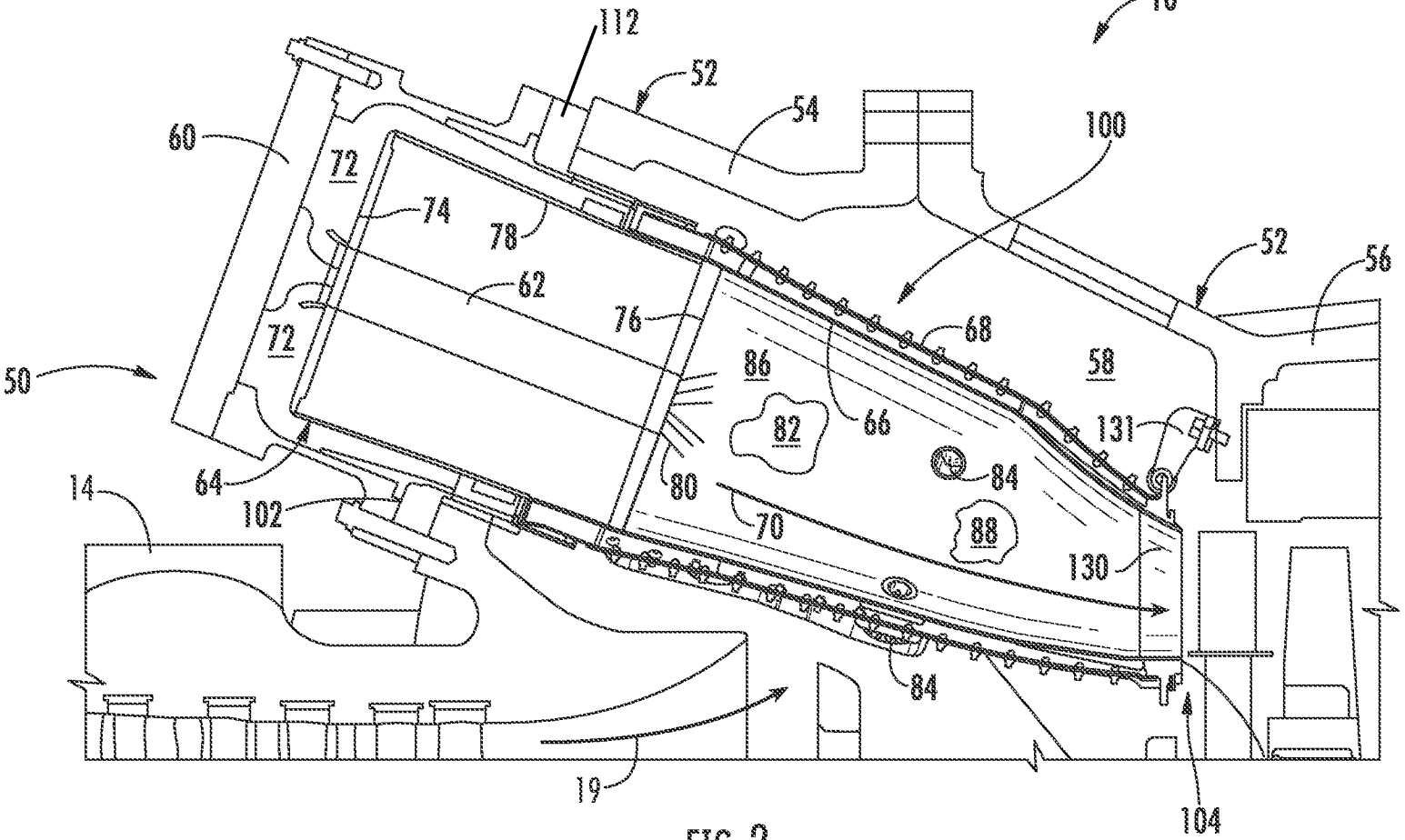
FIG. 2 illustrates is a cross-sectional side view of a portion of an exemplary turbomachine, including an exemplary combustor that may encompass various embodiments of the present disclosure.

As shown, gas turbine 10 generally includes an inlet section 12, a compressor section 14 disposed downstream of the inlet section 12, a plurality of combustors 50 (an example one of which is illustrated in FIG. 2) within a combustor section 16 disposed downstream of the compressor section 14, a turbine section 18 disposed downstream of the combustor section 16, and an exhaust section 20 disposed downstream of the turbine section 18. Additionally, the gas turbine 10 may include one or more shafts 22 coupled between the compressor section 14 and the turbine section 18.

The compressor section 14 may generally include a plurality of rotor disks 24 (one of which is shown) and a plurality of rotor blades 26 extending radially outwardly from and connected to each rotor disk 24. Each rotor disk 24 in turn may be coupled to or form a portion of the shaft 22 that extends through the compressor section 14.

The turbine section 18 may generally include a plurality of rotor disks 28 (one of which is shown) and a plurality of rotor blades 30 extending radially outwardly from and being interconnected to each rotor disk 28. Each rotor disk 28 in turn may be coupled to or form a portion of the shaft 22 that extends through the turbine section 18. The turbine section 18 further includes an outer casing 31 that circumferentially surrounds the portion of the shaft 22 and the rotor blades 30, thereby at least partially defining a hot gas path 32 through the turbine section 18.

During operation, a working fluid such as air flows through the inlet section 12 and into the compressor section 14 where the air is progressively compressed, thus providing pressurized air to the combustors of the combustor section 16. The pressurized air is mixed with fuel and burned within each combustor to produce combustion gases 34. The combustion gases 34 flow through the hot gas path 32 from the combustor section 16 into the turbine section 18, wherein energy (kinetic and/or thermal) is transferred from the combustion gases 34 to the rotor blades 30, causing the shaft 22 to rotate. The mechanical rotational energy may then be used to power the compressor section 14 and/or to generate electricity. The combustion gases 34 exiting the turbine section 18 may then be exhausted from the gas turbine 10 via the exhaust section 20.

FIG. 2 provides a cross-sectional side view of a portion of an exemplary gas turbine 10 including an exemplary combustor 50, e.g., which may be one of several combustors provided in the combustor section 16 illustrated in FIG. 1 and described above. The illustrated exemplary combustor 50 may encompass various embodiments of the present disclosure. As shown, the combustor 50 is at least partially surrounded by an outer casing 52 (such as a compressor discharge casing 54 that is disposed downstream from the compressor 14) and/or an outer turbine casing 56. The outer casing 52 is in fluid communication with the compressor 14 and at least partially defines a high pressure plenum 58 that surrounds at least a portion of the combustor 50. An end cover 60 is coupled to the outer casing 52 at one end of the combustor 50.

As shown in FIG. 2, the combustor 50 generally includes at least one axially extending fuel nozzle 62 that extends downstream from the end cover 60, an annular cap assembly 64 that extends radially and axially within the outer casing 52 downstream from the end cover 60, an annular hot gas path duct or combustion liner 66 that extends downstream from the cap assembly 64 and an annular flow sleeve 68 that surrounds at least a portion of the combustion liner 66. The combustion liner 66 defines a hot gas path 70 for routing the combustion gases 34 through the combustor 50. The end cover 60 and the cap assembly 64 at least partially define a head end 72 of the combustor 50.

The cap assembly 64 generally includes a forward end 74 that is positioned downstream from the end cover 60, an aft end 76 that is disposed downstream from the forward end 74, and one or more annular shrouds 78 that extend at least partially therebetween. In particular embodiments, the axially extending fuel nozzle(s) 62 extend at least partially through the cap assembly 64 to provide a first combustible mixture 80 that consists primarily of fuel and a portion of the compressed working fluid 19, e.g., air, from the compressor 14 to a primary combustion zone 82 that is defined within the combustion liner 66 downstream from the aft end 76 of the cap assembly 64.

In particular embodiments, the combustor 50 further includes one or more radially extending fuel injectors 84 (also known as axially staged fuel injectors or late-lean fuel injectors) that extend through the flow sleeve 68 and the combustion liner 66 at a point that is downstream from the at least one axially extending fuel nozzle 62. The combustion liner 66 defines a combustion chamber 86 within the combustor 50. In particular embodiments, the combustion liner 66 further defines a secondary combustion zone 88 that is proximate to the fuel injector(s) 84 and downstream from the primary combustion zone 82. In particular embodiments, the combustion liner 66, the flow sleeve 68 and the fuel injector(s) 84 are provided as part of a combustion module 100 that extends axially through the outer casing 52 and that circumferentially surrounds at least a portion of the cap assembly 64.

The combustion module 100 includes a forward or upstream end 102 that is axially separated from an aft or downstream end 104 with respect to an axial centerline 106 (FIG. 4) of the combustion module 100. As shown in FIG. 2, the combustion liner 66 extends downstream to and terminates at an aft frame 130. A mounting bracket 131 may be coupled to the aft frame 130. In some embodiments, the aft frame 130 and/or the mounting bracket 131 may be coupled to the outer turbine casing 56 and a mounting flange 112 may be connected to the compressor discharge casing 54 so as to constrain the combustion module 100 at both the forward and aft ends 102, 104 of the combustion module 100.

Figure 3:
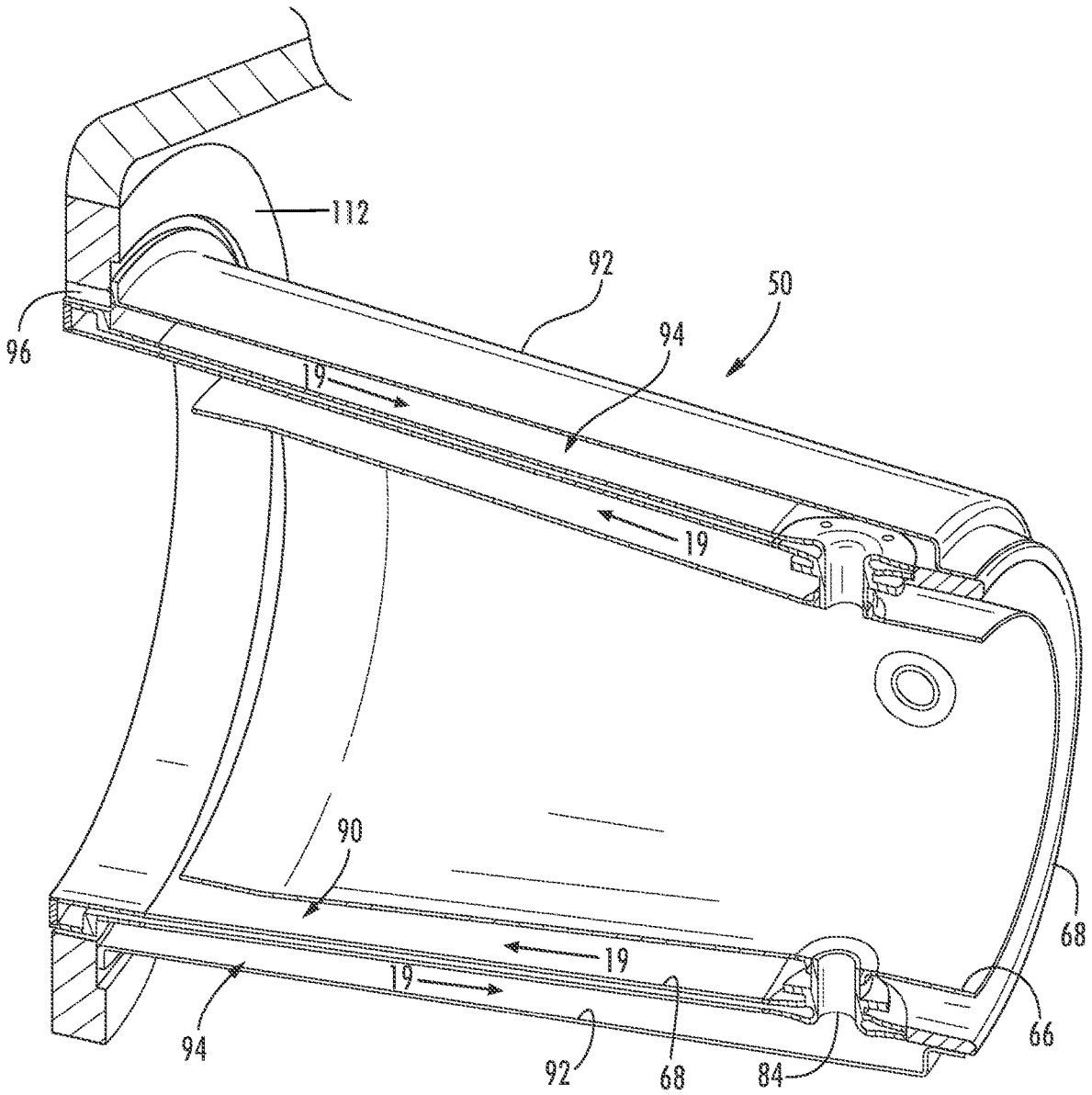
FIG. 3 illustrates a simplified side cross-sectional view of a portion of a combustor, according to one or more embodiments of the present disclosure.

FIG. 3 provides a simplified side cross-sectional view of a portion of the combustor 50, according to various embodiments of the present disclosure. As may be seen in FIG. 3, the flow sleeve 68 may circumferentially surround at least a portion of the liner 66, and the flow sleeve 68 may be spaced from the liner 66 to form a cooling flow annulus 90 therebetween. The compressed working fluid 19 from the compressor discharge plenum 58 may flow through the cooling flow annulus 90 along the outside of the liner 66 to provide convective cooling to the liner 66 before reversing direction to flow through the head end 72 and the axially extending fuel nozzle 62 (FIG. 2).

The plurality of fuel injectors 84 may be circumferentially arranged around the liner 66 and flow sleeve 68 downstream from the primary fuel nozzle(s) 62. The fuel injectors 84 provide fluid communication through the liner 66 and the flow sleeve 68 and into the combustion chamber 86. The fuel injectors 84 may receive the same or a different fuel than supplied to the fuel nozzle 62 and mix the fuel with a portion of the compressed working fluid 19 before or while injecting the mixture into the combustion chamber 86. In this manner, the fuel injectors 84 may supply a mixture of fuel and compressed working fluid 19 directly to the secondary combustion zone 88 for additional combustion to raise the temperature, and thus the efficiency, of the combustor 50. In the exemplary embodiment, the fuel is conveyed through passages defined in the flow sleeve 68, although fuel conduits disposed radially outward of the flow sleeve 68 (as shown in FIG. 4) may instead be used.

In some embodiments, as shown in FIG. 3, the combustor 50 may include at least one air shield 92 surrounding some of or all the plurality of fuel injectors 84. For example, a single air shield 92, such as is illustrated in FIG. 3, may, in some embodiments, circumferentially surround the fuel injectors 84 to shield the fuel injectors 84 from direct impingement by the compressed working fluid 19 flowing out of the compressor 14. Thus, the plurality of fuel injectors 84 are not in direct fluid communication with the high pressure plenum 58. The air shield 92 may be press fit or otherwise connected to the mounting flange 112 and/or around a circumference of the flow sleeve 68 to provide a substantially enclosed volume or second annular passage 94 between the air shield 92 and the flow sleeve 68. The air shield 92 may extend axially along a portion or the entire length of the flow sleeve 50, terminating at or slightly aftward of the fuel injectors 84. In the particular embodiment shown in FIG. 3, for example, the air shield 92 extends axially along the entire length of the flow sleeve 68 so that the air shield 92 is substantially coextensive with the flow sleeve 68.

Figure 4:
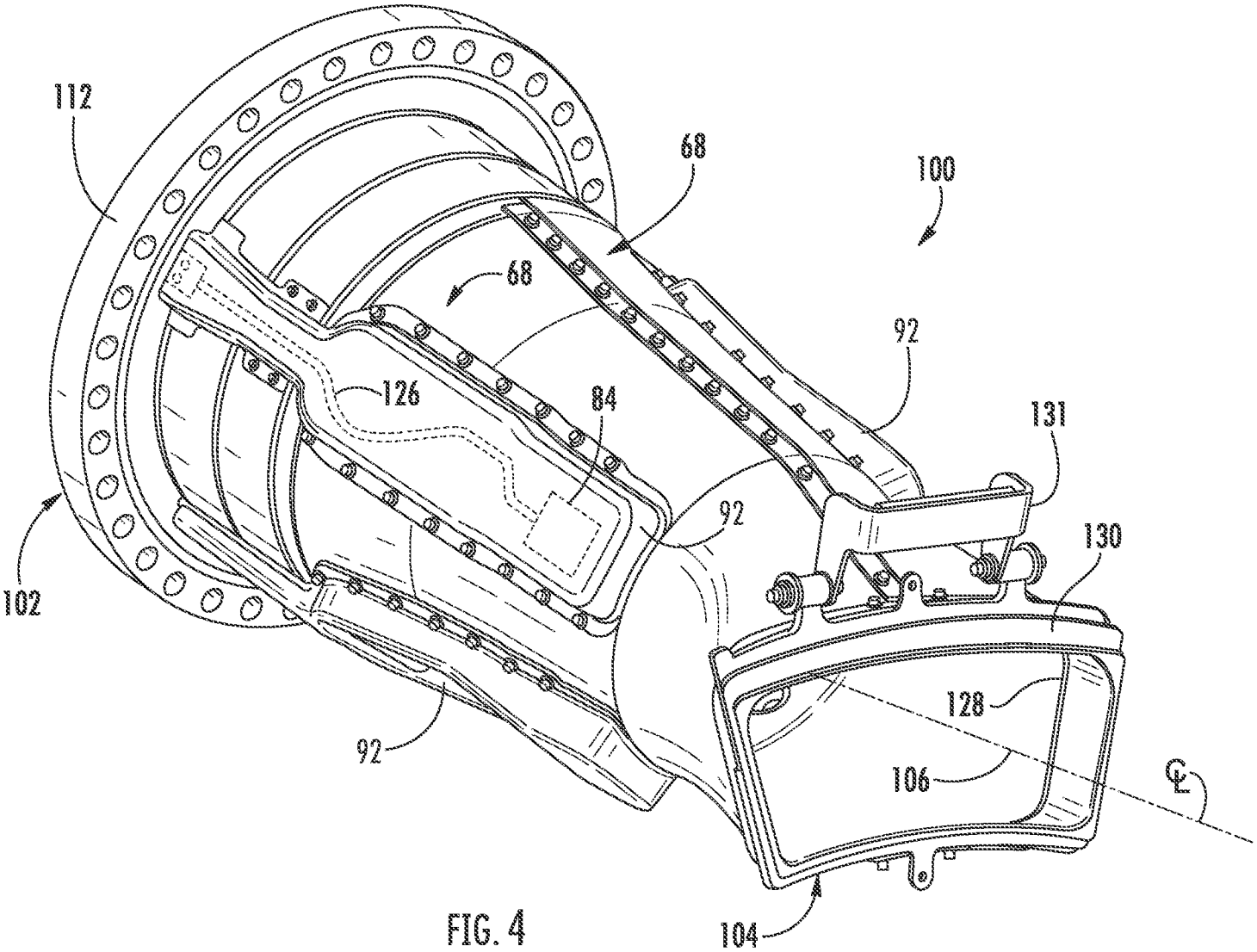
FIG. 4 illustrates a perspective view of a portion of a combustor for a turbomachine, according to one or more embodiments of the present disclosure.

In some embodiments, e.g., as illustrated in FIG. 4, a plurality of air shields 92 may be provided, such as one air shield 92 for each fuel injector 84, e.g., with a one-to-one correspondence between the air shields 92 and the fuel injectors 84, such that there is one air shield 92 for each fuel injector 84, and one fuel injector 84 is surrounded by each air shield 92. As shown in FIG. 4, each fuel injector 84 may be fluidly coupled to a fuel source through a fluid conduit 126 that extends between the fuel injector 84 and the mounting flange 112. Also as may be seen in FIG. 4, the aft frame 130 may be positioned at and extend around an aft or downstream end 128 of the combustion liner 66. For example, the aft frame 130 may circumferentially surround the aft end 128, e.g., as shown in FIG. 4.

Figure 6:
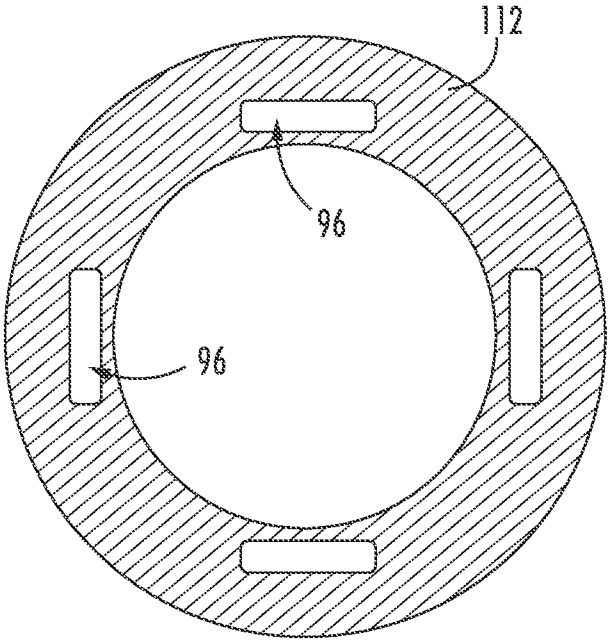
FIG. 6 illustrates a cross-sectional view of a flange of a combustor for a turbomachine, according to one or more additional embodiments of the present disclosure.
Figure 5:
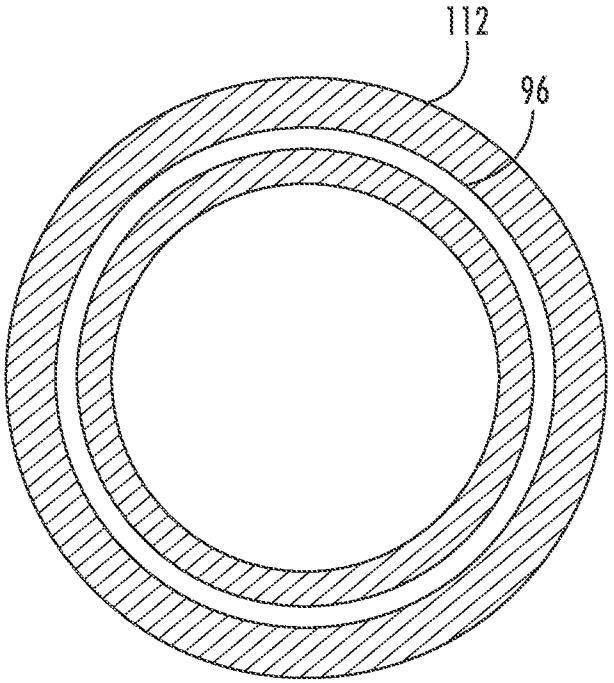
FIG. 5 illustrates a cross-sectional view of a flange of a combustor for a turbomachine, according to one or more embodiments of the present disclosure.

FIG. 5 illustrates a cross-sectional view of the flange 112 for use with embodiments including a single air shield 92, e.g., as illustrated in FIG. 3. In such embodiments, the flange 112 may include a single passage 96 which is continuous around the flange 112, e.g., the single passage 96 may extend circumferentially around the entirety of the flange 112, as illustrated in FIG. 5. FIG. 6 illustrates a cross-sectional view of the flange 112 for use with embodiments including multiple air shields 92, e.g., as illustrated in FIG. 4. In such embodiments, the flange 112 may include multiple passages 96 therethrough, and the multiple passages 96 may be arranged in a circumferential array across the flange 112, e.g., the multiple passages 96 may be spaced apart around the circumference of the flange 112, as illustrated in FIG. 6, such that each passage 96 aligns circumferentially with a respective air shield 92 and fuel injector 84.

Figure 7:
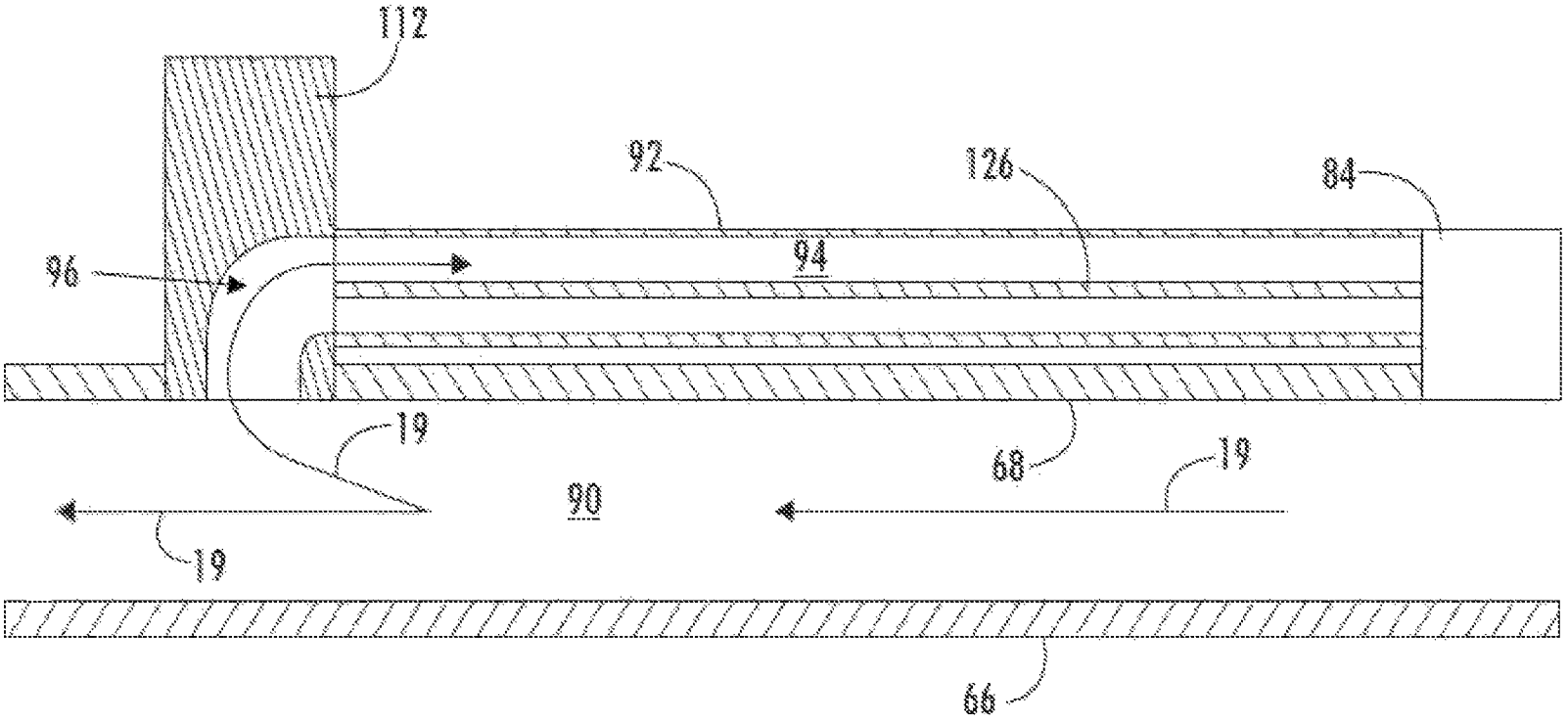
FIG. 7 illustrates a schematic cross-sectional view of portions of certain components of a combustor for a turbomachine, according to one or more embodiments of the present disclosure.

The enclosed volume 94 defined by the or each air shield 92 may be in direct fluid communication with a slot or passage 96 in the flange 112 to receive a direct flow of compressed working fluid, e.g., air, 19 from the flange 112 and to convey the air 19 to the plurality of fuel injectors 84, such as through one or more passages 96 in the mounting flange 112, e.g., as illustrated in FIGS. 3 and 7. For example, in various embodiments, a portion of the air 19 flowing through the cooling flow annulus 90 may be directed radially outwardly into the passage(s) 96, e.g., as illustrated in FIG. 7. Further, the flow of air 19 from the flange 112 to the plurality of fuel injectors 84 may be the only flow of air to the plurality of fuel injectors 84. Accordingly, the plurality of fuel injectors 84 may be entirely downstream of the flange 112 and only in indirect fluid communication with the high pressure plenum 58 and cooling flow annulus 90, e.g., via the flange 112 where the compressed working fluid (e.g., air) 19 only reaches the plurality of fuel injectors 84 after travelling entirely through the cooling flow annulus 90 and then at least the flange 112. Thus, the compressed working fluid may flow to the plurality of fuel injectors 84 only after flowing through the entire cooling flow annulus 90, e.g., along a continuous and uninterrupted flow path from the high pressure plenum 58 to the flange 112, e.g., via the cooling flow annulus 90. For example, the flow path from the high pressure plenum 58 to the flange 112 may be uninterrupted at least in that none of the compressed working fluid 19 from the high pressure plenum 58 is diverted to the plurality of fuel injectors 84 before reaching the flange 112. Such flow path may advantageously provide improved or increased cooling to the liner 66, e.g., as compared to designs which permit some of the compressed working fluid 19 to flow from the high pressure plenum 58 directly to the plurality of fuel injectors 84 before reaching the cooling flow annulus 90, such as before the compressed working fluid 19 flows through the entire cooling flow annulus 90.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A combustor for a turbomachine, the combustor coupled to an outer casing of the turbomachine and in fluid communication with a high pressure plenum within the outer casing, the combustor comprising:

an annular flange coupled to the outer casing;

a head end;

a liner at least partially defining a hot gas path including a first combustion zone and a second combustion zone downstream of the first combustion zone;

a flow sleeve circumferentially surrounding at least a portion of the liner, wherein the flow sleeve is spaced from the liner to form a cooling flow annulus therebetween, the cooling flow annulus in direct fluid communication with the high pressure plenum whereby air from the high pressure plenum flows into the cooling flow annulus and from the cooling flow annulus to the head end;

a plurality of fuel injectors in fluid communication with the second combustion zone, the plurality of fuel injectors configured to inject a mixture of fuel and air directly into the second combustion zone; and a plurality of air shields, each air shield extending from the annular flange and surrounding a respective fuel injector of the plurality of fuel injectors;

wherein the plurality of fuel injectors is not in direct fluid communication with the high pressure plenum.

2. The combustor of claim 1, wherein the combustor defines a continuous flow path from the high pressure plenum to the head end.

3. The combustor of claim 2, wherein the continuous flow path extends from the high pressure plenum to the head end via the cooling flow annulus.

4. The combustor of claim 1, wherein each fuel injector of the plurality of fuel injectors is surrounded by a corresponding air shield of the plurality of air shields.

5. The combustor of claim 1, wherein the annular flange is disposed proximate the head end, wherein the annular flange defines at least one passage in fluid communication with the cooling flow annulus for directing a flow of air from the cooling flow annulus to the plurality of fuel injectors.

6. The combustor of claim 5, wherein the flow of air directed to the plurality of fuel injectors via the at least one passage in the annular flange is the only flow of air to the plurality of fuel injectors.

7. A turbomachine, comprising:

a compressor extending from an inlet to a discharge, the discharge of the compressor providing a flow of high pressure air directly into a high pressure plenum defined within an outer casing of the turbomachine;

a combustor, the combustor comprising:

an annular flange coupled to the outer casing;

a head end;

a liner at least partially defining a hot gas path including a first combustion zone and a second combustion zone downstream of the first combustion zone;

a flow sleeve circumferentially surrounding at least a portion of the liner, wherein the flow sleeve is spaced from the liner to form a cooling flow annulus therebetween, the cooling flow annulus in direct fluid communication with the high pressure plenum whereby air from the high pressure plenum flows into the cooling flow annulus and from the cooling flow annulus to the head end;

a plurality of fuel injectors in fluid communication with the second combustion zone, the plurality of fuel injectors configured to inject a mixture of fuel and air directly into the second combustion zone; and a plurality of air shields, each air shield extending from the annular flange and surrounding a respective fuel injector of the plurality of fuel injectors;

wherein the plurality of fuel injectors are not in direct fluid communication with the high pressure plenum; and a turbine downstream of the combustor.

8. The turbomachine of claim 7, wherein the combustor defines a continuous flow path from the high pressure plenum to the head end.

9. The turbomachine of claim 8, wherein the continuous flow path extends from the high pressure plenum to the head end via the cooling flow annulus.

10. The turbomachine of claim 7, wherein each fuel injector of the plurality of fuel injectors is surrounded by a corresponding air shield of the plurality of air shields.

11. The turbomachine of claim 7, wherein the annular flange is disposed proximate the head end, wherein the annular flange defines at least one passage in fluid communication with the cooling flow annulus for directing a flow of air from the cooling flow annulus to the plurality of fuel injectors.

12. The turbomachine of claim 11, wherein the flow of air directed to the plurality of fuel injectors via the at least one passage in the annular flange is the only flow of air to the plurality of fuel injectors.

* * * * *